US005241151A

United States Patent [19]

Naruse et al.

[11] Patent Number: 5,241,151

[45] Date of Patent: Aug. 31, 1993

[54] CONTINUOUS ELECTRON BEAM IRRADIATION OF METAL STRIP

[75] Inventors: Yutaka Naruse; Yoshinori Anabuki; Kaizo Okamoto; Eiji Hina; Kiyoshi Wakabayashi; Takayuki Naoi; Hitoshi Aizawa, all of Okayama, Japan

[73] Assignee: Kawasaki Steel Corporation, Japan

[21] Appl. No.: 905,908

[22] Filed: Jun. 29, 1992

[30] Foreign Application Priority Data

Jun. 28, 1991 [JP] Japan ..... 3-184112

[51] Int. Cl.[5] ..... B23K 15/00

[52] U.S. Cl. ..... 219/121.12

[58] Field of Search ..... 219/121.12, 121.13

[56] References Cited

U.S. PATENT DOCUMENTS 4,577,088 3/1986 Sharp ..... 219/121.64

4,721,842 1/1988 Farrell ..... 219/121.28

*Primary Examiner*—C. L. Albritton

*Attorney, Agent, or Firm*—Austin R. Miller

[57] ABSTRACT

An electron beam irradiating apparatus continuously irradiates a running metal strip with an electron beam. An electron beam source can deflect the electron beam. At least one standby target is provided to receive the electron beam from the electron beam gun in a standby period in which the metal strip is not intended to be irradiated.

6 Claims, 5 Drawing Sheets

CONTINUOUS ELECTRON BEAM IRRADIATION OF METAL STRIP

BACKGROUND OF THE INVENTION

1. Field of the Invention

The present invention relates to a method of and an apparatus for continuously irradiating a running metal strip with an electron beam.

2. Description of the Related Art

Electron beam radiation has been used to improve characteristics of a metal strip, particularly to reduce iron loss in electromagnetic sheet sheet. The surface of a metal strip such as an electromagnetic steel strip, whether coated with ceramic or not, has been irradiated. This technique is disclosed, for example, in Japanese Patent Laid-Open Nos. 63-96218 and 63-186826.

A strongly condensed electron beam is applied to form linear traces which extend across the strip and which are arranged at a predetermined pitch in the longitudinal direction of the strip. The period of time of beam application for forming a single linear trace, and its pitch, are determined on the basis of the amount of input energy which provides maximum improvement in the characteristics of the strip.

Usually an electron beam gun is used as the source of the electron beam. It can perform a very quick scanning deflection of the beam by virtue of a deflection coil which also is known as a "deflection lens" or "electronic lens" but the beam gun cannot repeatedly turn the beam on and off at high frequency. Consequently, it has been necessary to apply the irradiation in a continuous mode.

In applying the electron beam technique to a practical production line, in ordinary cases, the strip velocity is determined on the basis of the production rate. When irradiation with an electron beam is applied, however, the velocity of the strip is controlled and limited on the basis of product quality, since the irradiation time for forming one linear trace and the pitch of the irradiation ar important in controlling the quality of the product.

Turning to FIG. 3 of the drawings, the optimum beam scanning speed is expressed as S and the scanning pitch is expressed as P. The irradiation width is expressed as W. The time Ts required for forming one linear trace is:

$$Ts = W/S \quad (1)$$

If the strip is conveyed through a distance P, the strip can be steadily or continuously irradiated. In such a case, the line velocity v is determined as:

$$v = P/Ts = (P/W) \cdot S \quad (2)$$

Thus, for continuous irradiation, the strip should be conveyed at the line speed "v," which limits the production rate. Consequently, the production rate must be controlled by the total working hours of the production line, i.e., on the basis of the number of days on which the operation is suspended. This undesirably involves wasteful use of the line driving system and requires complicated adjustment of schedules of the line operators.

SUMMARY OF THE INVENTION

Accordingly, an object of the present invention is to overcome the problems of the prior art by providing for continuously irradiating a running strip with an electron beam while enabling adjustment of production rate without degradation of product quality and without causing wasteful use of equipment or other inconvenience.

DETAILED DESCRIPTION OF THE INVENTION

After intense study we have discovered that an increased average line speed and other important objects of the invention can be achieved by simultaneously employing a novel irradiation combination including one or more "targets" which provide highly useful "standby periods" which will be further described in detail hereinafter.

In accordance with this invention a standby target, other than the running strip, is provided to absorb variations of the irradiation time and to enable the use of a more controllable and effective average line speed. When the strip speed is reduced for any reason, according to this invention, the electron beam is diverted from the running strip to the standby target for any surplus period, which period is surplus due to reduced velocity of the strip. Accordingly, beam irradiation of the strip is provided for the time and at the pitch required to attain the desired product quality.

The standby target is irradiated by the electron beam at different portions of the target from time to time. This is because continued irradiation at the same fixed point may otherwise damage the standby target.

The standby target is located within the scanning coverage of the electron beam. It is typically but not exclusively outside the path of the strip itself.

The standby target still tends to be damaged by heat even when irradiated at various positions on the target. The electron beam is typically applied in a vacuum and cooling by air convection cannot be performed. As a result heat tends to accumulate in the vacuum chamber. A special cooling device is accordingly associated with the standby target in accordance with this invention.

The above and other objects, features and advantages of the present invention will become clear from the following description of the preferred embodiments taken in conjunction with the accompanying drawings, which are intended to be exemplary but not to limit the scope of the invention, which is defined in the appended claims.

DESCRIPTION OF THE PREFERRED EMBODIMENTS

Figure 1:
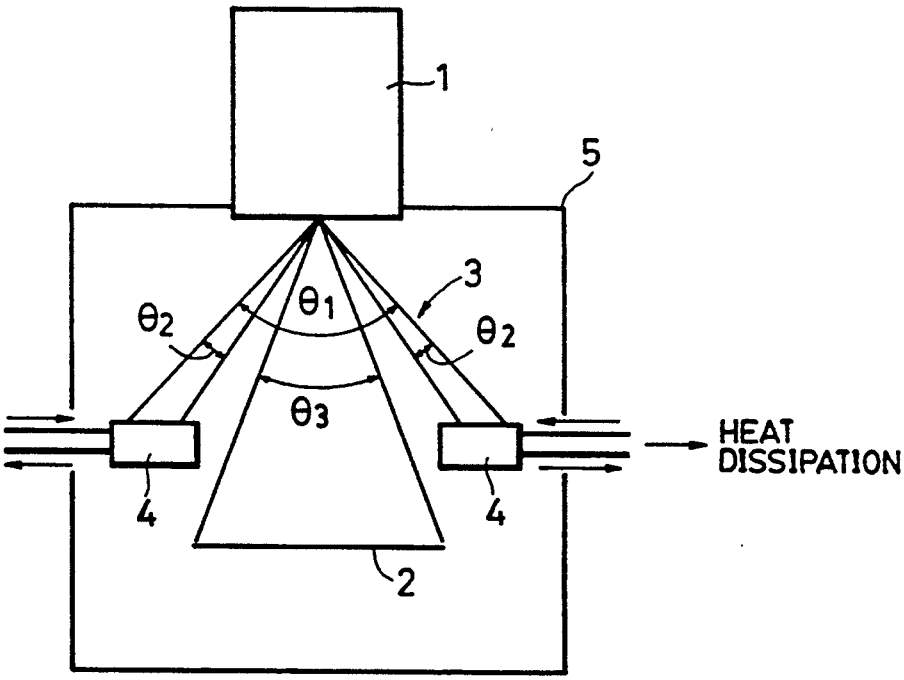
FIG. 1 is a schematic illustration of an electron beam irradiation apparatus embodying features of the present invention.

Referring to FIG. 1 of the drawings, a metal strip 2 to be irradiated is carried by the usual conveyor line (not shown) and continuously conducted through a vacuum chamber 5. The strip 2 is caused to run toward the reader, namely perpendicular to the plane of the shown portion of the vacuum chamber 5. The strip 2 is adapted to be scanned with an electron beam 3 emitted from an electron beam gun 1 which serves as an electron beam generator. The number 4 denotes novel standby targets according to this invention.

More specifically, the electron beam gun 1 is disposed in an upper portion of the vacuum chamber 5 and applies the electron beam 3 down onto the strip 2. The electron beam 3 is deflectable to a maximum deflection angle $\theta_1$ by a beam deflection coil attached to the electron beam gun 1. The irradiation of the strip with the electron beam 3 is effected within a relatively narrow angular range $\theta_3$ or a wider range $\theta_1$.

Each standby target 4 is positioned within an angular range $\theta_2$. When the strip 2 is not being irradiated i.e., in the standby time between successive scans conducted at a predetermined pitch or interval, the electron beam is deflected to one or the other of the standby targets 4, thus allowing time adjustment, whereby a great freedom is provided for change of line velocity.

It is therefore possible to adjust line velocity on the basis of production rate rather than beam irradiation speed and pitch This speed adjustment is afforded by provision and use of the standby targets 4, 4.

Preferably, the electron beam impinging upon a standby target 4 is oscillated through an angle such as $\theta_2$ so to avoid irradiation of a fixed point on the idle target, thus reducing damage and to achieve longer use.

However, efficient dissipation of heat from the standby target 4 is a problem because heat accumulates in the vacuum chamber 5, even despite the variation of the angle $\theta_2$. This problem, however, is overcome by providing cooling means such as water-cooled cooling means for the standby target 4.

The service lives of the standby targets can be extended remarkably by the combined use of beam oscillation and cooling.

Figure 2A:
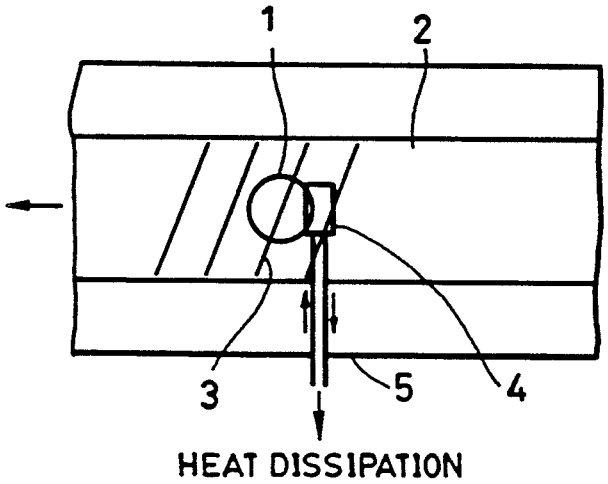
FIG. 2(*a*) is a schematic plan view and FIG. 2(*b*) is a schematic side elevation view of an irradiation apparatus in accordance with the present invention.
Figure 2B:
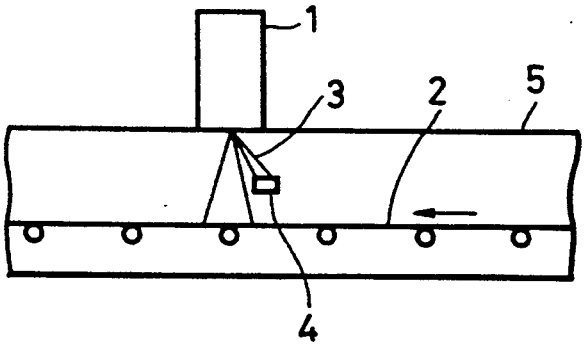
Figure 3:
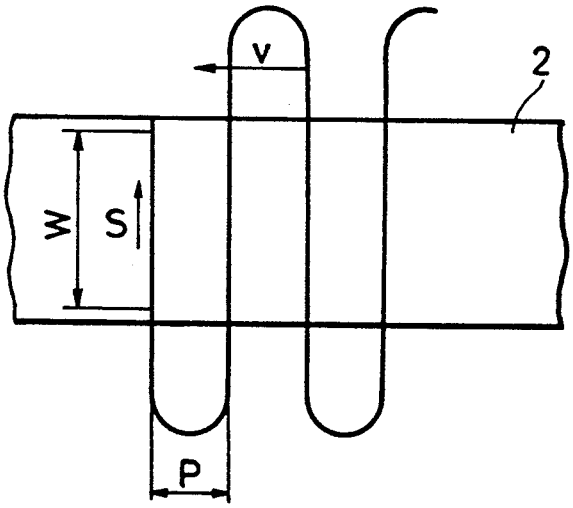
FIG. 3 is a schematic diagram indicating a typical irradiation and the path determination of line velocity.

The positions of the standby targets 4, 4 illustrated in FIG. 1 are only illustrative. FIGS. 2(*a*) and 2(*b*) illustrate a standby target 4 located on the strip path. The electron beam generator is adjusted to scribe lines perpendicular to the longitudinal axis of the running strip but has a deflection means operative in the longitudinal or running direction of the strip. During non-scribing intervals, the electron beam is longitudinally deflected to the standby target 4 which is offset from the line being scribed (FIG. 2(*b*)).

When the position to which the electron beam is applied is controlled by a deflection coil, the electron beam may irradiate the standby target in an oscillating manner. It is therefore preferred that the distance between the position of the beam on the standby target and the position at which the next scanning irradiation is to be commenced be kept constant, since otherwise the time required for the beam to move from one position to the other would vary and require a change in the time necessary for starting up the deflection coil. In such a case, the position at which the next scanning irradiation is commenced would fluctuate undesirably.

In actual use the lines of irradiation are scribed by rapidly repeating movements of the beam at periods of only several tens of microseconds (μs) and through tiny distances on the order of several tens to several hundreds of microns (μm). Any variation of the time required for moving the electron beam from a non-scribing position to the scanning start position causes a variation in the time over which the beam stays in an irradiating mode on the start position. This undesirably disturbs control of electron beam irradiation.

This problem, however, can be resolved by arranging the beam and the standby targets 4 such that the electron beam is applied to a standby target 4 along an arcuate path centered at the start position of scanning irradiation so as to maintain a constant distance between the position of the electron beam on the standby target and the start position, thus maintaining constant the time required for the electron beam to move from one position to the other.

This can be realized by employing an arcuate or ring-shaped standby target and placing it in a plane perpendicular to the line interconnecting the source of the electron beam and the position at which the irradiating scanning is commenced, at such a position that the center of the arc or ring-like form of the standby target coincides with the scanning irradiation start position.

Figure 4A:
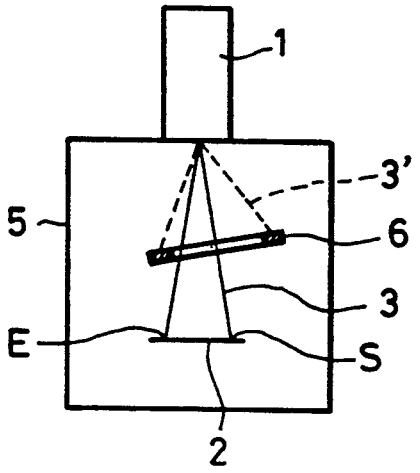
FIGS. 4(*a*) and 4(*b*) are schematic illustrations of another beam irradiation apparatus embodying features of the present invention.
Figure 4B:
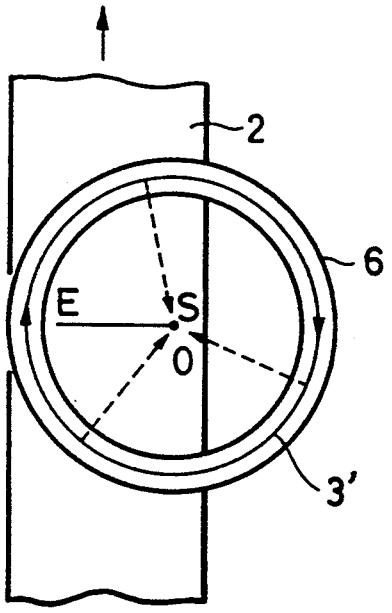

FIGS. 4(*a*) and 4(*b*) illustrate such a continuous electron beam irradiating apparatus. In FIG. 4(*a*) the strip 2 is running toward the reader as in FIG. 1 while FIG. 4 is a plan view. The number 6 denotes a ring-shaped standby target. The beam moves across the strip 2 from the start position S to the end position E. As shown in FIG. 4(*a*), the standby target 6 is disposed in a plane perpendicular to a line extending between the source of the electron beam and the start position S. The center O of the target 6 coincides with the center of the path of movement of the beam to the start position S.

In the stand-by period, the electron beam 3' (FIG. 4(*a*)) is applied to the standby target 6 so as to irradiate it along a circle 3' (FIG. 4(*b*)) centered at the start position S. When the next scanning irradiation instruction is received the beam 3' is quickly moved to the start position S. The time required for the electron beam to reach the start position S is constant regardless of the position of the electron beam on the standby target 6 because the radial distance (FIG. 4(*b*)) between these positions is constant.

In the embodiment shown in FIG. 4, the electron beam gun 4 is required to have a deflection ability for directing the electron beam to the standby target and for oscillating the beam on the target and this ability is more significant than the deflection ability for swinging the electron beam between the scanning star and end positions S and E.

Figure 5:
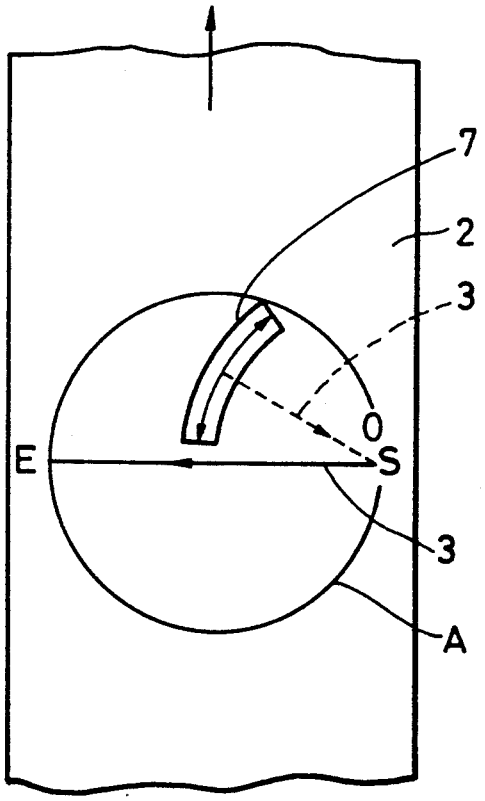
FIG. 5 is a schematic plan view of still another beam irradiation apparatus embodying features of the present invention.

FIG. 5 shows another embodiment. In general, an electron beam gun has a deflection ability which enables the electron beam to be swung two dimensionally, i.e., in the x and y directions, with the same amount of deflection. More specifically, the electron beam is generally deflectable within a circle A as shown in FIG. 5. It is desirable that the electron beam coverage on the strip is maximized for a given deflection ability of the electron beam source, because the maximized coverage enables reduction in the number of the electron beam sources required to cover a given width or range. In the embodiment shown in FIG. 5, the scanning irradiation start point S and the scanning irradiation end point E are set at both end extremities of the beam coverage indicated by the circle A, and the standby target is positioned within this circle A which indicates the maximum beam coverage presented by the electron beam gun as the beam source.

In the embodiment shown in FIG. 5, which is a plan view, the standby target 7 has an arcuate form which is a part of a circle centered at a point 0 which coincides with the scanning irradiation start point S. The length or size of the target 7 is determined such that the target 7 is within the area of the circle A which bounds the maximum area over which the electron beam is deflectable. The electron beam during the stand-by period reciprocately scans the idle target 7 along an arcuate path centered at the scanning irradiation start position S and conforming with the arcuate form of the target 7. The electron beam then flies to the scanning irradiation start position S when the next scanning instruction is given.

EXAMPLE

For the purpose of this Example, it is assumed that the beam scanning speed, scanning pitch and the width scanned by the electron beam are respectively 10 m/s, 10 mm and 100 mm, for attaining maximum improvement of the strip.

In such a case, the time Ts required for scribing a linear trace is determined as follows:

$$Ts=(100\text{ mm})/(10\times10^3\text{ mm/s})=0.01\ s$$

Therefore, for the purpose of effecting continuous irradiation, it is necessary to feed the strip by 10 mm which equals to the scanning pitch, within a period of 0.01 s.

The line speed v, therefore, is definitely determined as follows:

$$v=(10\text{ mm})/(0.01\text{ s})=1000\text{ mm/s}=60\text{ mpm}$$

It is assumed here that the line speed v has to be reduced from 60 mpm to 40 mpm due to production control. At such a reduced line speed, the time required for the 10 mm feed of the strip is 0.015 s as given by the following calculation:

$$(10\text{ mm})/(40\times1000\text{ mm}/60\text{ s})=0.015\ s$$

Consequently, the difference between the time Ts (0.01 s) required for completing one linear trace and the above-mentioned time 0.015 sec required for 10 mm feed of the strip, i.e., 0.005 sec, is generated as surplus time.

According to the invention, this surplus time is absorbed by causing the electron beam to stay on a standby target for the period of 0.005 second which is equal to the surplus time. It is thus possible to control the velocity of feed of the strip on the basis of the production control requirement.

The invention also permits variation in line speed which is often required for reasons other than production control, such as the conditions of upstream or downstream facilities. e.g., variation of the line speed due to welding of successive strips For instance, when it is necessary to reduce the line speed from 60 mpm to 40 mpm, it becomes necessary to suspend the beam irradiation for a surplus time of 0.005 s which equals the difference between the time Ts (0.01 s) required for completing one linear trace and the time 0.015 sec required for 10 mm feed of the strip as calculated as (10 mm)/(40×1000 mm/60 s)=0.015 s.

Repeated on-off control of the electron beam gun, however, is not easy to achieve. Consequently, the required improvement in strip characteristics could not previously be obtained in the regions which are irradiated with the electron beam immediately before and after turning the beam on and off.

According to the invention, however, the problem is solved because the electron beam is alternatively directed to the standby target without being turned on and off repeatedly.

Thus, the present invention provides a greater degree of freedom in the determination of line speed by virtue of the standby target which absorbs surplus time of beam irradiation caused by a variation in line speed.

Although this invention has been described with reference to specific embodiments, these are not intended to limit the scope of the invention. Many other arrangements may be used for applying the electron beams, for guiding them, and for moving them back and forth between the running strip and one or any number of standby targets. The standby targets may themselves be provided in various shapes, forms and positions and may be of wide varieties of materials. Other variations may be made, including reversals of parts, use of equivalents and the use of certain features independently of other features, all without departing from the spirit and scope of the invention as defined in the appended claims.

What is claimed is:

1. In a method of continuously irradiating the surface of a continuously running metal strip with an electron beam to form linear traces on said surface for improving surface characteristics of said metal strip, while conducting said strip continuously along a predetermined path, the steps which comprise (a) providing a standby target at or adjacent said metal strip path; causing said electron beam to scan said surface at a predetermined scanning speed and pitch, (b) changing the speed of said continuously running metal strip, and (c) causing said electron beam to irradiate said standby target when said strip is not desired to be irradiated by said electron beam.

2. A method of continuously irradiating a running metal strip with a electron beam, while conducting said strip along a predetermined path, comprising: providing a standby target at or adjacent said path; providing an optimum beam irradiation time period necessary for forming a linear trace of the beam on said metal strip; irradiating said metal strip with said electron beam for said optimum time period; and displacing said electron beam to said standby target in a period other than said optimum beam irradiation time period.

3. A method according to claim 1, wherein said electron beam is directed to varying positions on said standby target.

4. Apparatus for continuously irradiating a running metal strip with an electron beam to form linear traces on the surface of said metal strip for improving surface characteristics of said metal strip, comprising:

an electron beam source having beam deflection means including moving means for moving said beam from a working position directed at said strip to a standby position separate from said strip; and at least one standby target spaced from said strip and positioned to receive a beam deflected by said deflection means in a standby period in which said metal strip is not desired to be irradiated with said electron beam.

5. Apparatus for continuously irradiating a running metal strip with an electron beam, comprising:

an electron beam source having beam deflection means; and at least one standby target positioned to receive said electron beam in a standby period in which said metal strip is not to be irradiated with said electron beam, and wherein said standby target is provided with cooling means.

6. Apparatus for continuously irradiating a running metal strip with an electron beam, comprising:

an electron beam source having beam deflection means; and at least one standby target positioned to receive said electron beam in a standby period in which said metal strip is not to be irradiated with said electron beam, said standby target being so positioned that the center of said standby target coincides with said irradiation start position.

* * * * *